US005325698A

United States Patent [19]

Nagpal et al.

[11] Patent Number: 5,325,698

[45] Date of Patent: Jul. 5, 1994

[54] STEPPED EXTRUSION DIE ASSEMBLY

[75] Inventors: Vijay Nagpal, Westland; William J. Fuhrman, Bloomfield Hills; David H. Dodds, South Lyon, all of Mich.

[73] Assignee: Ford Motor Company, Dearborn, Mich.

[21] Appl. No.: 953,343

[22] Filed: Sep. 30, 1992

[51] Int. Cl.[5] ..... B21K 1/30

[52] U.S. Cl. ..... 72/267; 72/358; 29/893.34

[58] Field of Search ..... 72/264, 354.2, 354.6, 72/358, 359, 391.2, 343, 266, 267; 29/893.34

[56] References Cited

U.S. PATENT DOCUMENTS

| | | | |
|---|---|---|---|
| 3,186,210 | 6/1965 | Lesher et al. | 72/467 |
| 3,608,350 | 9/1971 | Yamaguchi | 72/358 |
| 3,910,091 | 10/1975 | Samanta | 72/256 |
| 4,287,749 | 9/1981 | Bachrach et al. | 72/467 |
| 4,350,865 | 9/1982 | Bachrach | 219/69 |
| 4,622,842 | 11/1986 | Bachrach et al. | 72/467 |
| 4,878,370 | 11/1989 | Fuhrman et al. | 72/264 |

*Primary Examiner*—Lowell A. Larson

*Attorney, Agent, or Firm*—Roger L. May; Frank G. McKenzie

[57] ABSTRACT

A extrusion die assembly for cold extruding internally and/or externally toothed gears and the like, particularly internally toothed ring gears, with the mandrel for forming the internal teeth in the workpiece including axially successive sets of die teeth, with each set including a full complement of annularly arranged and equally spaced die teeth, and the die teeth from the leading set to the trailing set increasing progressively in diameter.

In one embodiment, the die teeth from one set to the next on the mandrel extrude the gear teeth in equal radial depth, and in a second embodiment, the die teeth of each succeeding mandrel set extrude the gear teeth by displacing an equal volume of material from one set to the next.

The die teeth in each set on the mandrel including a relief portion of progressively decreasing radial dimension, the workpiece being arrested on the die assembly such that all extrusion of the workpiece axially along the mandrel is in the direction of the relief portion, thereby maintaining at a minimum frictional contact between the mandrel and the workpiece.

9 Claims, 3 Drawing Sheets

STEPPED EXTRUSION DIE ASSEMBLY

TECHNICAL FIELD

This invention relates to the forming of gears from wrought material by extrusion of the material, and particularly to the die design and technique for the cold extrusion of helical gear teeth on an annular gear blank.

BACKGROUND OF THE INVENTION

The cold extrusion of gears, such as externally toothed pinion gears and internally toothed ring gears for vehicular automatic transmissions is an extremely advantageous gear manufacturing process. The process provides a precise forging requiring only minimal trim and finished grind operations to produce a finished part. However, cold extrusion does require that significant extrusion forces be applied against the forging blank to cause cold flow of the material. Thus, a forging press having a high tonnage rated capacity is required. Further, the forces on the die teeth are significantly high, thereby creating high residual stresses which can contribute to the breakage of the die teeth, or other premature failure. High frictional forces are also a concern, i.e., the frictional force between the blank being forged and the inner or outer die pieces.

When such gears are provided with helical gear teeth, bending stress on the die teeth is also of concern. Bending stress is caused by the fact that the metal of the gear blank is caused to change direction from pure axial flow (i.e., coaxially with the press anvil such as with spur gears) to a combined axial and helical direction of flow typical of helix gears. The bending stress is greatest at the forward end of the die tooth. Various designs for the die teeth have been proposed to minimize bending stress in this area, such as shown in U.S. Pat. Nos. 4,622,842 and 5,052,210 assigned to the assignee of the present invention.

It is also known to reduce the stress on the die teeth by eliminating or substantially reducing the friction between the gear blank and the non-toothed die part. Such a technique is shown and described in U.S. Pat. No. 4,878,370, also assigned to the assignee of the present invention, the teachings of which are incorporated herein by reference. Therein, there is shown the forging of an internally toothed helical ring gear wherein the annular outer die ring is axially spring-loaded, and thereby allowed to move with the workpiece at a maximum rate equalling that of the punch as the workpiece is extruded through the length of the mandrel. Friction between the workpiece is further reduced by utilizing a free-floating, self-centering mandrel, and by providing the mandrel die teeth with a tapered relief portion rearward of the leading end of the die teeth.

Broaching is also a common technique for producing gears, particularly ring gears, i.e. by cutting the teeth to near finished or finished dimension. The commonly used single axially reciprocating broach may include an axially incremental tooth configuration, in sections, such that at each section more and more of the desired finished tooth profile is cut by the broach. Typically, for a helical ring gear having a six inch internal diameter, the broach is in the order of ten to twelve feet long. It is made of high grade steel and extremely expensive to fabricate. It does produce a precision part, and the finishing operations are less than that of the cold extrusion technique described above.

Further with the broaching of helical gear teeth, it is common to allow the broach and/or the workpiece to rotate about the axis of the broach (and annular outer die part) to allow cutting the teeth on a helix.

SUMMARY OF THE INVENTION

The present invention contemplates an improved cold extrusion process for forming gears from wrought gear blanks.

The invention further contemplates a cold extrusion process and die structure for forging the aforesaid gear blanks using a minimum extrusion force.

The invention further contemplates a forging die design for cold extruding helical gear teeth, and a method for doing so, which minimizes the establishment of bending stresses on the die gear teeth.

The invention further contemplates the aforesaid die design and forging technique as applied to the high volume production of helical gears having either external or internal teeth.

The invention further contemplates the aforesaid forging technique and die design wherein the gear is forged by placing an annular gear blank having a precision inner diameter ("ID") and precision outer diameter ("OD") dimension within an annular outer die member having an ID constructed to hold the precision OD of the gear blank. Then the gear blank is piloted on an inner die member or die mandrel having an OD matching the ID of the precision gear blank. Thereafter the gear blank is caused to axially pass through one die member, and the axial position of the gear blank at the leading end of the die member is maintained fixed in position, whereby the gear blank is extruded in a direction toward its leading end and opposite that of the relative axial movement of the one die member.

The invention also contemplates the immediately preceding technique wherein the inner die member or mandrel is passed through a stationary gear blank and stationary outer die piece and includes axially successive sets of die teeth radially progressing at each set to thereby increase the forging depth of the teeth on the gear blank at each increment or step of the mandrel.

The invention further contemplates the aforesaid stepped mandrel wherein the number of steps ranges from three to six, preferably four, with the increase in the radial dimension of the die teeth being proportioned to provide or establish the approximate same extrusion force on the gear blank.

The invention further contemplates the aforesaid stepped mandrel wherein the final step on the mandrel is a finishing step whereby the radial dimension of the teeth is increased only slightly beyond that of the next preceding step.

The invention further contemplates the aforesaid forging technique and die design for cold extruding helical gear teeth wherein the rotational frictional force between the stationary gear blank and axially stationary die member is eliminated by allowing the axially stationary die member to rotate with the induced rotation of the helical gear blank; or alternatively, to allow the reciprocating die member to rotate with the gear blank.

The features, objects and other advantages, of the present invention are readily apparent from the following detailed description of the best mode for carrying out the invention when taken in connection with the accompanying drawings.

BEST MODE FOR CARRYING OUT THE INVENTION

Figure 1:
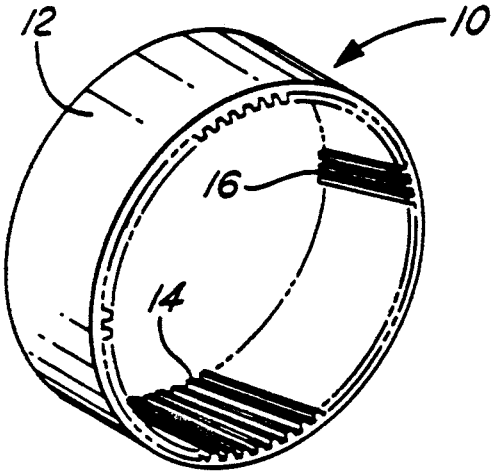
FIG. 1 is a perspective view showing a finished ring gear made in accordance with the invention.

Looking to the drawings, in FIG. 1, there is shown a ring gear designated generally by the reference character 10. It includes an annular shell 12 of precise diameter and internal helical gear teeth 14 which are extruded during the process. The workpiece from which the ring gear 10 is formed during the extrusion process is an annular ring with precision machined outside and inside diameters. It is fitted over a pilot portion 22 of the mandrel designated generally as 20 in FIG. 2. Mandrel 20 is a cylindrical member on which are formed external die teeth 24, the shape of which will be described below.

The ring gear 10 may be extruded from an aluminum alloy material if the gear forces that would act on the teeth are relatively small. If higher gear forces are required, the ring gear stock or blank should be steel, such as SAE 5130 steel. In either case, the metal of the workpiece is extruded through the die teeth 14 as metal is displaced. This, of course, increases the axial length of the workpiece, and that axial growth is taken into account in the precision machining of the blank.

Figure 2:
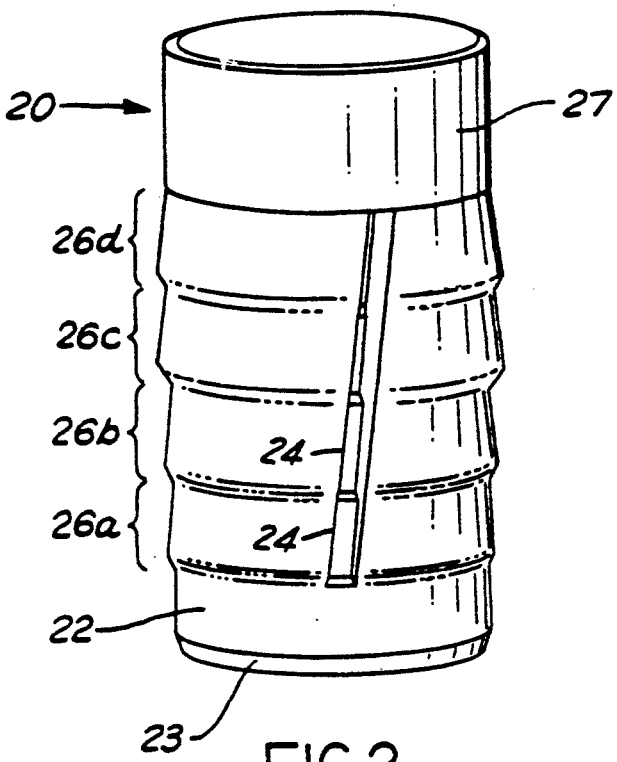
FIG. 2 is a perspective view of the progressively stepped forming mandrel in accordance with the invention.
Figure 3:
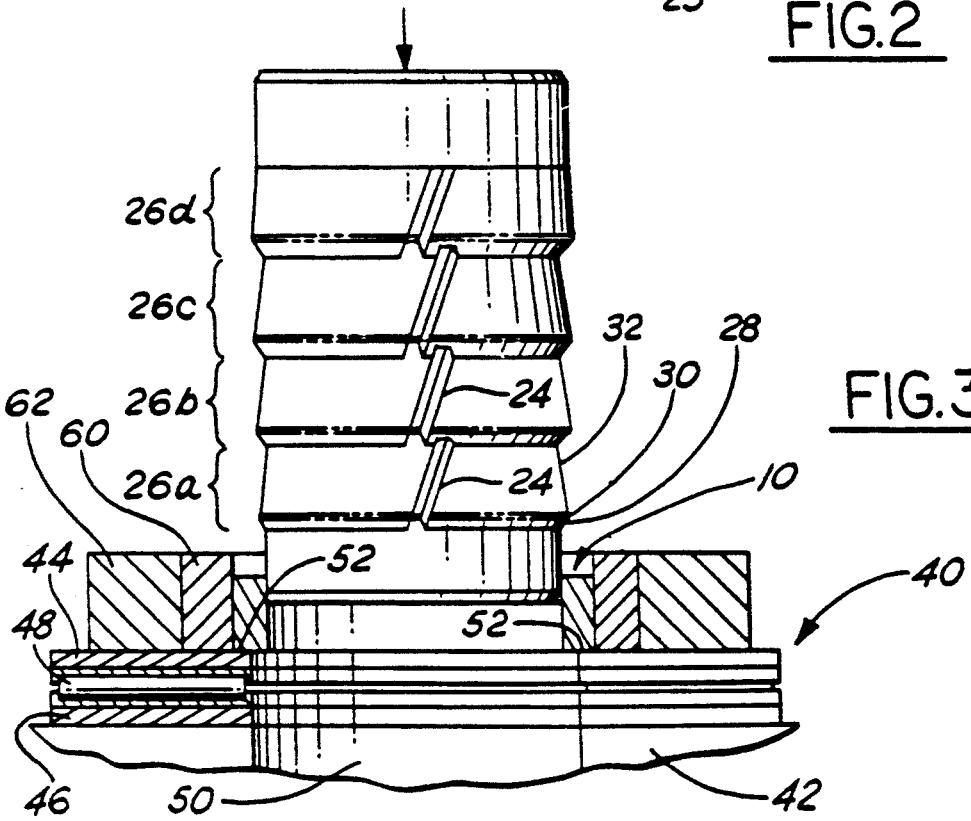
FIG. 3 is a partially sectioned elevation view showing the extrusion die assembly in accordance with the invention.

It will be noted, particularly from FIGS. 2 and 3, that the mandrel 20 includes a series of successively, axially arranged segments *26a-26d*, with each segment including a plurality of helical die teeth 24. Four such segments or sets of die teeth are shown. Each segment includes a full complement of equally annularly spaced die teeth arranged about the circumference of the mandrel 20 and conforming to the gear teeth 14 shown in FIG. 1, or more correctly, the ring gear teeth grooves 16, shown in FIG. 1. Each die tooth in one segment is axially aligned on a helix with a respective die tooth of the next succeeding segment, such that the axially successively arranged aligned die teeth will form in progression a particular finished ring gear tooth.

Although discussed more fully below, it will be noted from FIGS. 2 and 3 that the die teeth 24 in each segment include a lead-in or tapered portion 28 at the leading end of the die tooth, a metal extruding portion 30, and a relief portion 32. The metal extruding portion 30 is of a common diameter for all of the die teeth in a particular segment, but is formed with a progressively increasing outside diameter beginning with the first segment *26a* through to the final segment *26d*. The relief portion 32 of each die tooth in each segment is formed with a progressively decreasing outside diameter, and the thickness of each tooth in the relief portion 32 is slightly less than that at the extruding portion 30, i.e. across the lands (not shown) which conventionally adjoin the lead—in portion 28, such as removing 0.0015 inch material on each flank as by EDM process or electrolytic etching.

Thus, as the mandrel is passed through the workpiece, the die teeth will be extruded in stages dependent on the relative depth and thickness of the successively aligned die teeth 24 through each set or segment *26a-26d*.

In FIG. 3, the remaining details of the press assembly are shown. The gear blank or workpiece 10 is shown to be supported on a press bed bearing pad, generally designated 40, which in turn, is supported on a press bed 42. The bearing pad 40 includes an upper annular base plate 44 and a lower annular base plate 46. Interposed between the annular base plates 44, 46 and supporting the upper base plate 44 is a plurality of annularly arranged roller bearings 48. Both the bearing pad and the press bed include an annular bore 50 of diameter intermediate that of the workpiece whereby there is formed a shoulder 52 at the inner rim of the bearing pad for the purpose of supporting the workpiece.

The annular workpiece 10 is closely contained within an annular die ring 60 having a precision machined inside diameter that matches the desired outside diameter of the workpiece 10. The outer die ring 60 is retained by an annular outer die retainer 62 having an inside diameter adapted to match that of any of any number of die rings that may be selected for producing a variety of differently sized ring gears. Both the outer die retainer 62 and die ring 60 are also supported on the press bed bearing pad 40.

The mandrel 20 is axially aligned with the annular bore 50 of the press bed 40, and the pilot portion 22 of the mandrel is selected to be in sliding fit with the gear blank, and is tapered at its leading end as shown at 23 to thereby assure accurately receiving the workpiece. The mandrel is mounted within a hydraulic press (not shown) at its trailing end 27.

In operation, once the workpiece 10 is placed within the die ring 60, the hydraulic press forces the mandrel 20 through the workpiece beginning with the pilot portion 22 and continuing with each successive die segment *26a-26d* and concluding with the final die segment such that the finished ring gear 10 is completely extruded. Thereafter, the mandrel 20 is withdrawn, the finished workpiece 10 stripped from the die assembly, and a second workpiece is inserted within the outer die ring.

Since the workpiece 10, die ring 60 and outer die retainer 62 are merely supported on the upper base plate 44 of the bearing pad, the outer die ring assembly and workpiece are self-centering and free-floating relative to the mandrel 20. Further, since each is supported on the rotatable bearing pad, the workpiece and outer die ring assembly may rotate relative to one another, thereby reducing the amount of friction between the workpiece and outer die ring 60. Concurrently or in addition to this feature, the mandrel itself may be rotatably mounted on the hydraulic press. Thus, as the helical gear teeth are extruded, no severe rotational stress will be placed on any part of the die assembly including the workpiece.

Friction between the workpiece 10 and mandrel 20 is further reduced by providing each die tooth profile in each segment with the relief portion 32 described earlier.

Figure 3A:
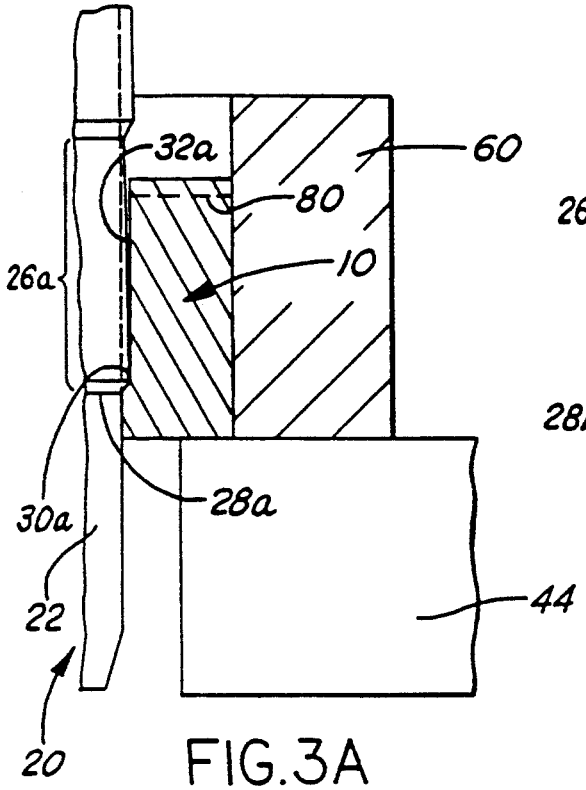
FIGS. 3A-3D show a portion of the extrusion die assembly of FIG. 3 in its various operating positions for the steps used in the extrusion process in accordance with the invention.
Figure 3B:
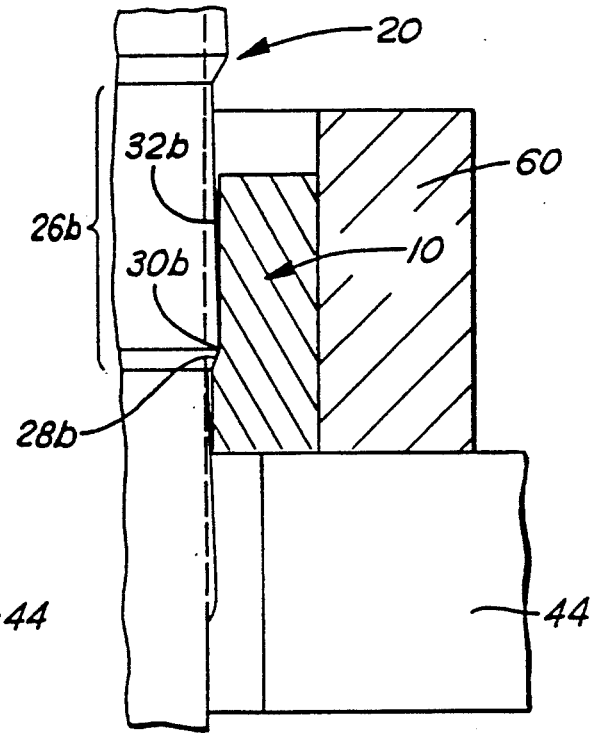
Figure 3C:
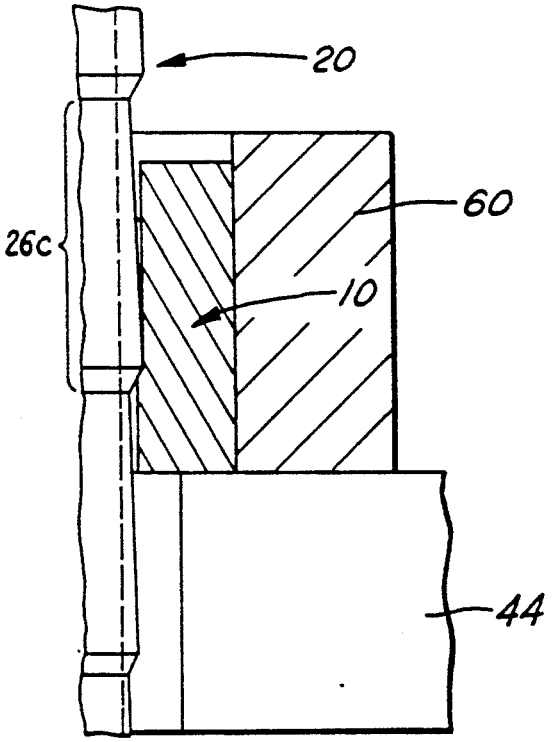
Figure 3D:
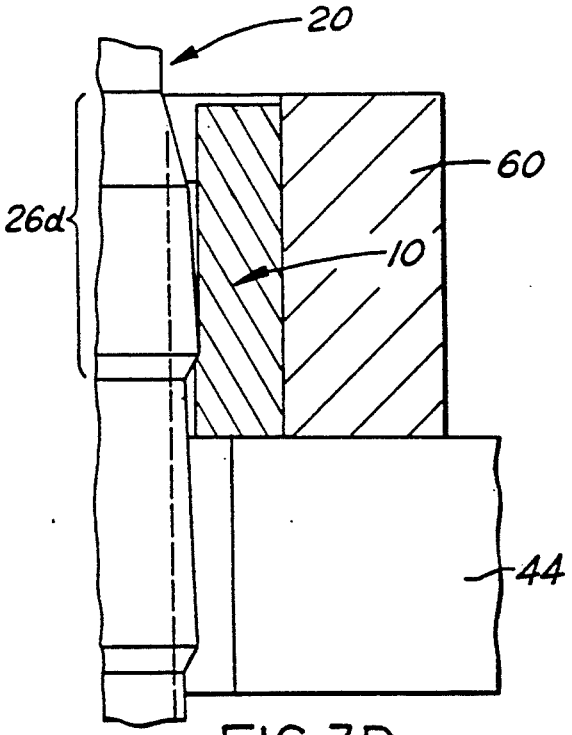

In FIGS. 3A-3D, there is shown the progressive formation of the die teeth in the workpiece 10 as each successive segment 26*a*–26*d* of the mandrel 20 is caused to pass axially through the workpiece. It will be noted that the axial length of each die segment is approximately equal to and slightly greater than that of the workpiece 10. Preferably, the length from one extruding portion 30 to the next extruding portion 30 of the next succeeding die tooth, e.g. from extruding portion 30*a* to extruding portion 30*b*, will be slightly greater to accommodate the increased length in the workpiece as the gear teeth are formed. Preferably also, the extruding portion 30 of the leading die segment will have passed completely through the workpiece before the next extruding portion 30 engages the workpiece. In other words, the lead-in tapered portion 28*b* of the next succeeding gear tooth segment should be engaged at one end of the workpiece just as the metal extruding portion 30*a* has passed through the workpiece. This minimizes the press capacity required to complete the extruding and at the same time assures the alignment of the workpiece with the die teeth. Phantom line 80 in FIG. 3A represents the initial height or length of the workpiece. It will be noted throughout FIGS. 3A-3D that the workpiece has steadily grown in length as the gear teeth are being formed.

Figure 4:
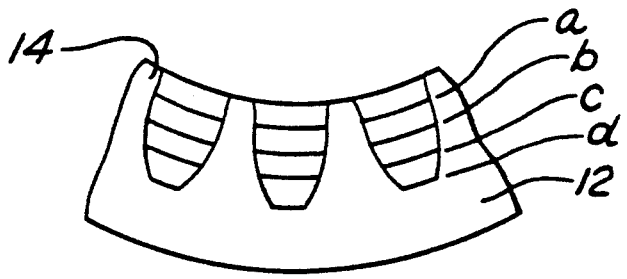
FIG. 4 is a plan view of a portion of the internally toothed ring gear of FIG. 1, and showing schematically a process concept in the progressively stepped extrusion of the toothed profile in accordance with one embodiment of the invention.
Figure 4A:
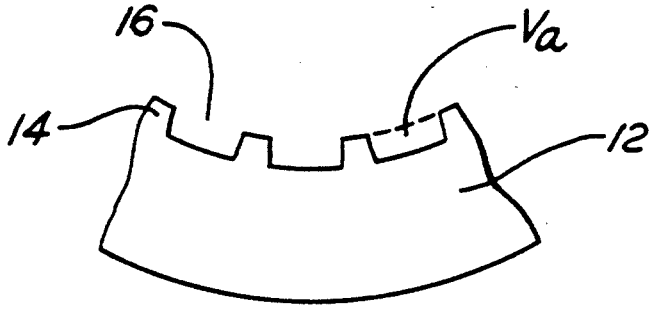
FIGS. 4A-4D show various sequential stages of extruding the internal toothed formation at each progressive step in the extrusion mandrel, as illustrated schematically in FIG. 4.
Figure 4B:
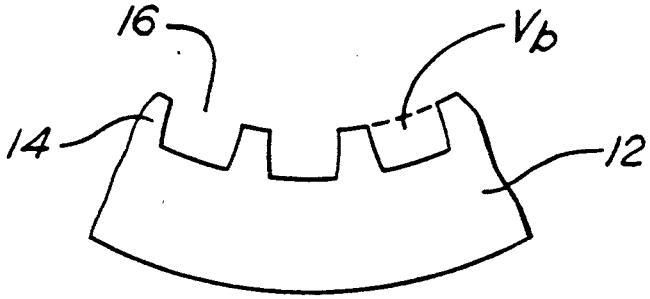
Figure 4C:
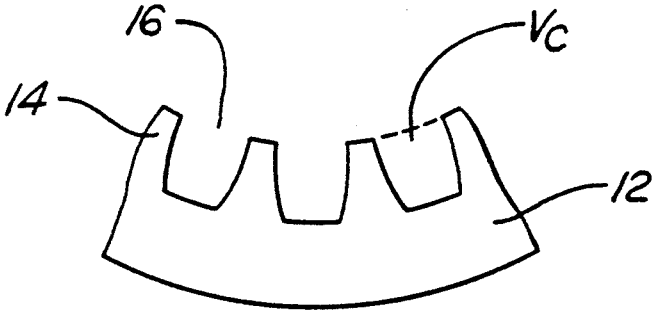
Figure 4D:
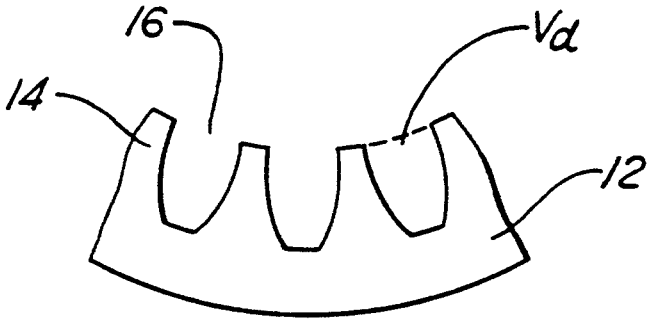

In FIGS. 4 and 4A-D, there is shown a representation of the sequential extruding of the gear teeth at each segment 26*a*–26*d* of the mandrel. In one preferred embodiment of the invention, it is desired that the die teeth 14 be of progressively radially increasing diameter in equal radial increments such that the lines depicted at a–d represent an equal depth of tooth formation. Thus, in FIG. 4A, there is shown the results of the passing of segment 26*a* of the mandrel 20 through the workpiece 10, and the same for FIGS. 4B–4D, with FIG. 4D representing the finished gear tooth profile established by metal extruding portion 26*d*.

In accordance with a second preferred embodiment of the invention, the increasing radial dimension of the die teeth from one segment 26 to the next throughout all segments 26*a*–26*d* increases equally in ring gear tooth volume. Thus, the volume Vb of the gear tooth as partially formed by the passing of mandrel segment 26*b* is half that of the volume Vc formed by the passing of the third mandrel stage 26*c* and is twice that of the gear tooth volume Va of the first mandrel segment 26*a*.

Following extrusion of the gear teeth and the workpiece, the usual finishing steps are required, namely facing both ends of the workpiece, deburring the gear teeth at each end, hardening the workpiece as by carbonitriding, and then sandblasting and/or washing the part to clean all surfaces of extrusion preparation coating, heat treat oxidation, and the like.

The press assembly described above, particularly as shown in FIG. 3, is basically for a low volume production technique, with one part at a time being formed at the press station.

Other press techniques are available, such as shown in U.S. Pat. No. 4,878,370, which is incorporated herein by reference, whereby the mandrel is stationary and an annular punch is adapted to load and force through the mandrel a second axially stacked workpiece. Thus, as one finished workpiece is coming off the trailing end 27 of the mandrel, i.e. segment 26(*d*), a new annular workpiece is being placed over the pilot portion of the mandrel. Given the present invention, the technique described in U.S. Pat. No. 4,878,370 would be modified to provide a plurality of axially stacked workpieces equal in number to the number of gear die teeth segments or sets on the mandrel.

Although reference has been made throughout to the formation of helical gear teeth on an internally toothed ring gear, the above-described die assembly and technique is equally applicable to the extruding of spur gear teeth on a ring gear. Further, with suitable adaptations as will be known to one of ordinary skill in the art, the technique is equally applicable to the formation of externally toothed gears. Likewise, although reference is made throughout to the particular use of the die assembly of the present invention for cold extrusion applications, those skilled in the art will recognize its usefulness in warm forging and hot forging applications.

While the best mode for carrying out the invention has been described in detail, those familiar with the art to which this invention relates will recognize various alternative designs and embodiments for practicing the invention as defined by the following claims.

We claim:

1. An extrusion die assembly for forming by extrusion an annular part generally symmetrical about an axis, said annular workpiece being hollow and thereby defining an inner surface and an outer surface, with each said surface being coaxially disposed about said axis, and said workpiece having a generally uniform length along said axis extending from a leading end to a trailing end, a first die member, a second die member, said first and second die members being coaxially disposed relative to one another and reciprocal relative to one another, each said die member having an extrusion forming surface contiguous with a respective one of said inner and outer surfaces of said workpiece, with said workpiece being disposed between the relatively reciprocal first and second die members, one of said die members including means for extruding a radially projection profile in said workpiece, said profile being of uniform configuration including depth and volume throughout its axial length from the leading end of said workpiece to the trailing end thereof, said means including a series of successively axially spaced die profile segments, each die profile having a leading end and a trailing end, the leading end thereof increasing radially in substantially equal proportion from one die profile segment to the next successively arranged die profile segment, whereby as each die profile is successively traversed across said workpiece from one segment to the next segment, said profile will be formed in said workpiece in uniformly successive stages; and means for maintaining the axial position of the workpiece at the leading end thereof fixed relative to said other die member as the leading end of any one of said die segments axially traverses said workpiece in the direction of the workpiece leading end, whereby axial extrusion of the workpiece is limited to the direction towards the trailing end of said workpiece and said die segment.

2. The invention of claim 1 wherein said first die member includes a radial relief at the trailing end of each of said successively arranged radial die forming portions, whereby the only friction between the first die member and the workpiece being extruded is at the area of contact of the leading end of each said successively arranged die-forming profile on said first die member.

3. The invention of claim 2 wherein each said successive radially projecting die portion of said die member projects radially a substantially radial extent from that of the preceding die profile whereby the profile is formed in said workpiece by successively extruding the profile in equal depth as each die profile is traversed through said workpiece from the trailing end of the workpiece to the leading end of the part.

4. The invention of claim 2 wherein each said successive radially projecting die portion of said die member projects radially a substantially radial extent from that of the preceding die profile whereby the profile is formed in said workpiece by successively extruding the profile in equal volume as each die profile is traversed through said workpiece from the trailing end of the workpiece to the leading end of the workpiece.

5. The die assembly of claim 1 wherein said one die member is a mandrel and said other die member includes an outer ring within which is located the workpiece;

means for allowing at least one of said mandrel and outer die ring to rotate about the axis of said mandrel to thereby accommodate any lead angle of said helical die teeth and thereby reduce or eliminate any bending stress during extrusion of the workpiece.

6. The die assembly of claim 5 wherein each said set of die teeth increase in radial dimension from that of the preceding set of die teeth by a predetermined equal radial increment whereby the depth of each gear tooth is extruded in progressively equal amounts form one set of die teeth to the next succeeding set of die teeth.

7. The die assembly of claim 6 wherein said extruding portion is located near the leading end of each die tooth and said relief portion is located near the trailing end of each die tooth;

said extruding portion being the maximum radial extremity of each die tooth; and said relief portion being of progressively decreasing radial dimension from the said extruding portion to the trailing end of said die tooth.

8. The die assembly of claim 5 whereby the depth of each gear tooth in one said set of die teeth increases in radial dimension from that of the preceding set of die teeth by a predetermined radial increment whereby the volume of each gear tooth is extruded in progressively equal amounts from one set of die teeth to the next succeeding set of die teeth.

9. The die assembly of claim 8 wherein said extruding portion is located near the leading end of each die tooth and said relief portion is located near the trailing end of each die tooth;

said extruding portion being the maximum radial extremity of each die tooth; and said relief portion being of progressively decreasing radial dimension from the said extruding portion to the trailing end of said die tooth.

* * * * *